United States Patent [19]

Stoyshin

[11] 4,126,401

[45] Nov. 21, 1978

[54] COMBINATION SUDSER AND RINSER BRUSH

[76] Inventor: Donald A. Stoyshin, 1043 Moy Ave., Windsor, Ontario, Canada

[21] Appl. No.: 779,829

[22] Filed: Mar. 21, 1977

[51] Int. Cl.[2] ..... A46B 11/04

[52] U.S. Cl. ..... 401/42; 401/289

[58] Field of Search ..... 401/40, 41, 42, 43, 401/268, 286, 289, 291

[56] References Cited

U.S. PATENT DOCUMENTS

| | | | |
|---|---|---|---|
| 2,613,381 | 10/1952 | Tucker | 401/43 |
| 2,705,622 | 4/1955 | Laub | 401/40 X |
| 2,708,599 | 5/1955 | Grikscheit | 401/43 X |
| 3,131,868 | 5/1964 | Coleman | 401/289 X |
| 3,453,059 | 7/1969 | Noble | 401/291 X |
| 3,989,390 | 11/1976 | Thorner | 401/42 |

*Primary Examiner*—Edward M. Coven
*Attorney, Agent, or Firm*—Charles Krassov

[57] ABSTRACT

This invention consists of a device for washing and rinsing any items from small dishes to large cars. It is made up of a hollow cylindrical body having a long neck at the front thereof which terminates into a hollow circular perforated chamber which forms the back of a circular brush. Totally enclosed in the cylinder body is a central narrow pipe the rear end of which extends beyond the body for attachment to a water supply hose; while the front end of said pipe extends beyond the said brush chamber. The pipe has a constricted area for increasing the water velocity; a pinhole in its wall to feed water slowly in the body and around the said pipe; and a slightly perforated front end located within the brush. A hollow handle which is the container for soap or detergent, extends at right angles from the wall of the body and communicates with its interior, so that the slow moving water in the interior of the body mixes with the detergent in the handle, and feeds the brush, but does not come in contact with the water in the central pipe.

1 Claim, 2 Drawing Figures

COMBINATION SUDSER AND RINSER BRUSH

This invention consists of a device for washing and rinsing dishes, pots, and pans, and large units such as cars by directing a jet of water at the items to be washed and at the same time applying a soap-detergent laden brush to said items for the purpose of releasing and removing any particles which adhere to their surfaces.

At the present time there are a number of such devices upon the market. These devices have many objectionable characteristics in common, such as spring loaded push buttons, some movable parts, and inadequate rinsing ability. Various push button controls and movable parts are constantly subject to disrepair. The feed of detergent to the jet of water can be turned on or shut off, however, shutting off the soap or detergent does not prevent a residual quantity of these cleansing materials from being dissolved in the rinse water, thereby causing an undesirable film to remain upon the surface of the rinsed item. Also, because of the large number of components which make up the finished washer, and the extra cost of their assembly, make their manufacturing costly and their selling price quite high.

It is therefore the object of this invention to provide a washing and rinsing device which is of simple and low cost construction; which does not contain any movable parts nor spring loaded controls which are troublesome by constantly going out of order; and in which the rinsing water does not come in contact with the soap or detergent element at any time so that the rinsed item is sparkling clean.

This is accomplished in the invention by providing a construction to the device in which there are no movable parts, and in which the said detergent or soap element is fed to the brush part of the device, and the water jet is separated from and independent of the brushing device.

Figure 1:
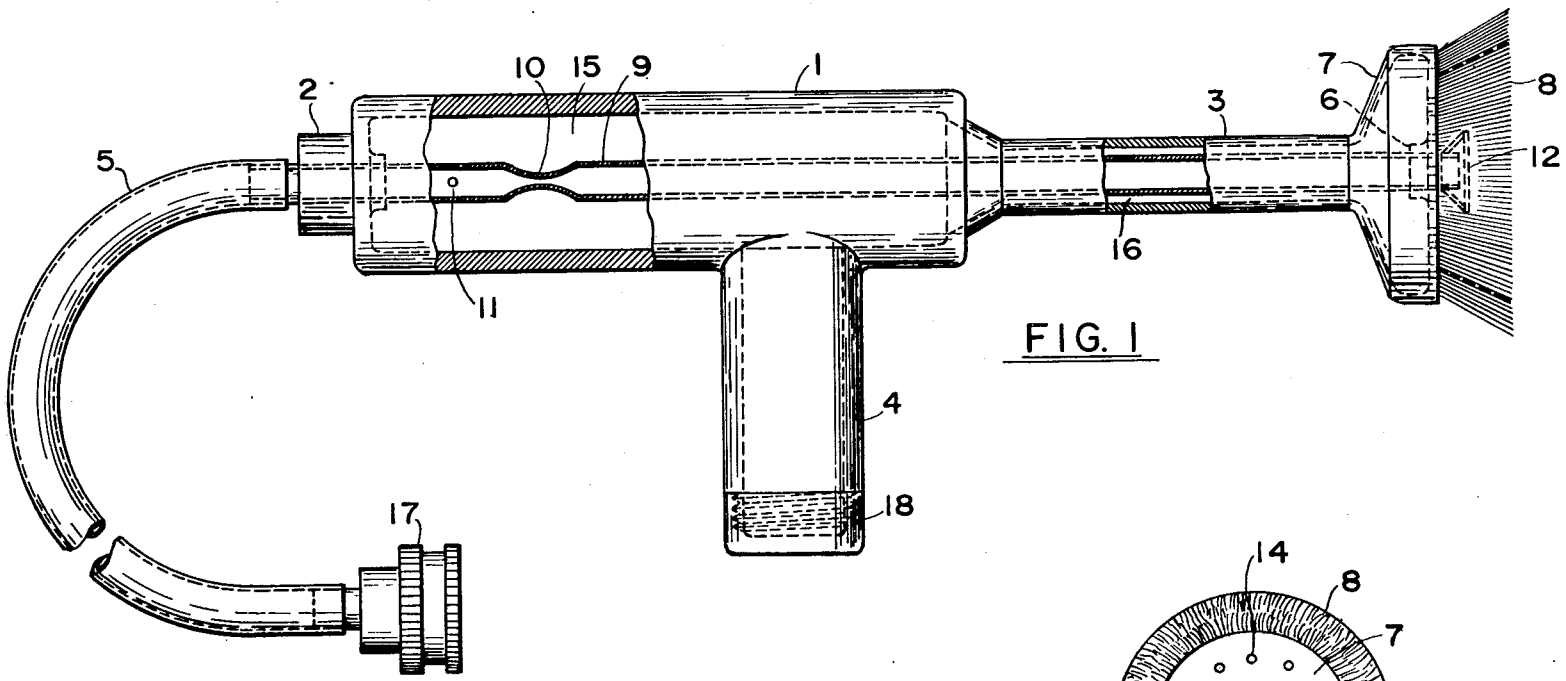
Figure 2:
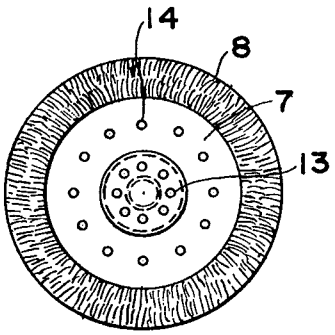

In describing the invention reference will be made to the attached drawings in which, FIG. 1 is an elevation of the invention shown partly in section, and FIG. 2 is a front view of the washing and rinsing part of the invention.

In the drawing is shown a cylindrical hollow body 1 having a short cylindrical centrally located boss 2 at the rear end thereof, and an extended centrally located hollow cylindrical neck 3 at the front end thereof. A cylindrical hollow tube extends from the body 1, it communicates with the hollow interior 15 of said body. The tube 4 has a dual purpose, i.e. it serves as the container for the cleansing ingredient such as soap or liquid detergent, and it constitutes the handle by means of which the device is held during the washing and rinsing operation. The soap or detergent is fed into the tube 4 by unscrewing the cap 18 at the bottom of the tube 4.

To the front end of the neck 3 is attached centrally an enclosed hollow chamber 7 which communicates with the neck 3; it is circular in shape, and of larger diameter than the body 1. To the circular rim of the face of the chamber 7 is attached a circular brush 8, and the said face is provided with a plurality of perforations 14.

A pipe 9, which is centrally located within the body 1 is held in a fixed position by the boss 2 at its rear end, and by a boss 6 within the chamber 7. The pipe 9 extends beyond the boss 2 so that a flexible hose 5 can be attached to it. The hose 5 is in turn attached to a water supply tap by a tap connection 17. The front end of the pipe 9 extends beyond the perforated face of the chamber 7, and it terminates in a somewhat expanded circular rinsing head 12, the face of which is provided with a plurality of perforations 13. This rinsing head ends within and to the rear of the brush 8 so that it does not interfere with the scrubbing operation of the brush. The pipe 9 is provided with a constricted part 10 for the purpose of providing an increased velocity to the water jet passing through the said pipe, and a pinhole 11 which provides a slow stream of water which slowly fills the space 15 and mingles with the detergent in the handle 4. The mixture of water and detergent passes through the space 16 in the neck 3, and out of the perforations 14, under reduced pressure.

The operation of the device is quite simple. After it has been connected to the water supply, the water is turned on and the scrubbing operation begins. The scrubbing is done by the use of the brush which is saturated with the water and detergent mixture, and also with the aid of the water jet from the rinse head 12. When this part of the cleansing operation is completed, the device is moved away a short distance from the item which is being washed so that the brush with its detergent does not come in further contact with the said item; however, the clean water jet which does not contain any soap or detergent and which does not come in contact with the detergent covered parts of the device, strikes the surface of the washed item and rinses away any dirt or residual soap or detergent film.

From the above description the advantages of this invention from the point of view of efficiency and low construction cost, are easily recognizable.

Having described the invention, what I claim is:

1. A device for washing various items with a mixture of water and detergent, and rinsing said washed items with detergent free water, comprising a hollow tubular body with one end thereof closed and the other end extending into a hollow narrow neck, the space within said neck being a continuation of the space within said body; said neck terminating in a hollow backed circular brush, and the face of said brush being perforated; a hollow tubular handle extending at right angles from said body for containing detergent therein, the space within said handle being connected with the space within said body; a screw cap at the bottom of said handle for opening and closing it; a narrow centrally located water pipe running through the interior of said body and neck, extending at the rear end thereof, beyond said body for the attachment of a water hose thereto, and extending beyond the said brush face, at the front end thereof; the front end of said pipe terminating into a perforated rinsing head located within, but separated from the bristles of said circular brush; a constricted area within said water pipe for providing a venturi effect therein; and a pinhole in said water pipe for feeding water into the space within said body and around the exterior of the water pipe, under reduced pressure.

* * * * *